US005823147A

United States Patent [19]

Hitchcock, Jr.

[11] Patent Number: 5,823,147

[45] Date of Patent: Oct. 20, 1998

[54] STEAM GENERATOR STEAM DRUM MOUNTING

[75] Inventor: J. C. Hitchcock, Jr., Signal Mountain, Tenn.

[73] Assignee: Combustion Engineering, Inc., Windsor, Conn.

[21] Appl. No.: 902,801

[22] Filed: Jul. 30, 1997

[51] Int. Cl.[6] ..... F22B 37/24

[52] U.S. Cl. ..... 122/510; 248/288.31

[58] Field of Search ..... 122/510, 511, 122/512; 248/58, 324, 288.31

[56] References Cited

U.S. PATENT DOCUMENTS 3,263,656 8/1966 Kurek, Jr. ..... 122/510
3,410,253 11/1968 Svendsen ..... 122/510
4,408,570 10/1983 Dominguez et al. ..... 122/510
5,005,637 4/1991 Gentry ..... 122/510

*Primary Examiner*—Teresa J. Walberg
*Assistant Examiner*—Gregory A. Wilson
*Attorney, Agent, or Firm*—Robert S. Smith

[57] ABSTRACT

A steam generator having a steam drum and which includes first and second U-shaped members dimensioned and configured for cradling the steam drum. Each of the first and second U-shaped members has first and second elongated leg portions and each of the leg portions is supported by a separate first body. The first body is supported by a separate second body, one of the bodies has a concave spherical section face and the other has a convex spherical section face, the concave spherical section face and the convex spherical section face are disposed in abutting load bearing relationship. Thus, a discrete set of first and second bodies is associated with each of the leg portions.

18 Claims, 4 Drawing Sheets

STEAM GENERATOR STEAM DRUM MOUNTING

BACKGROUND OF THE INVENTION

The invention relates to steam generating apparatus particularly the upper steam drum and the mounting for the upper steam drum. While the invention has particular application to such apparatus it will be understood that the invention has application for supporting other very heavy apparatus. An example of one steam generating apparatus in which they present invention has application is a controlled circulation boiler designed to provide steam to a turbine generator. This example of apparatus in which the present invention may be used is illustrated in detail in the book Combustion Fossil Power, edited by Joseph G. Singer, P. E. and published by ABB Combustion Engineering, Inc. Particular attention is directed to page 7–21 of the 1991 edition of this publication.

A typical steam drum is approximately 60 to 100 feet long, has an inside diameter of 4 to 7 feet, a wall thickness of 3 to 8 inches and is mounted approximately 100 to 200 feet above the ground. The weight of the drum typically is between 50 and 350 tons. The ordinary internal pressure within the drum is 2900 pounds per square inch and the operating temperature is about 700 degrees Fahrenheit. Ordinarily, these pressures and temperatures will be maintained for 24 hours a day, 7 days per week for 40 years!

The mounting of the steam drum is complicated by the thermal expansion of the drum as well as the physical connection between the drum and the rest of the boiler unit. In a typical steam generator the physical connection between the steam drum and the main part of the boiler unit is about 70 feet long. Thus, the mounting for the steam drum must accommodate the thermal expansion of the drum as well as the physical connection. The combined length of the steam drum and the physical connection is thus approximately between 130 and 170 feet. This substantial length combined with temperature differentials between operating and shutdown modes of approximately 630 degrees Fahrenheit explains the magnitude of the physical travel requires for the mounting. The weight and size characteristics of the steam drum further complicate the task of providing a satisfactory mounting.

The prior art approach to supporting the steam drum utilized two giant U-shaped members. These U-shaped members, sometimes called U bolts or drum hanger rods, cradle the ends of the steam drum with the two legs of each member extending vertically up. Each of the upper ends of the U-shaped members cooperate with cylindrical members that rest in cylindrical seats. The seats allow some movement of each leg. The movement is somewhat analogous to the motion of the pendulum in a grandfather dock. In other words, if there was no bending of the leg, the locus of the positions of the axis of each leg is a plane that perpendicular to the axis of the cylindrical member. The axis of the leg in all positions of the leg will intersect the axis of the cylindrical member.

This prior art approach requires positioning the geometric axis of the respective cylindrical members associated with the legs on any one U-shaped member in parallel relationship. The precise angular orientation of the cylindrical members will necessarily be calculated for each new steam generator. The calculation must consider the length of the steam drum and the length of the connection from the steam drum to the boiler. The engineering calculations also must consider leg bending moments due to horizontal movement in any direction of the drum and drum hanger rods.

Ordinarily, one of a range of various sizes of cylindrical members are selected for each new steam generator, the length of the U-shaped members, the moment and the thermal expansion. The size selected for any one steam generator has been a function of the weight of the steam drum. The use of different size cylindrical members creates a complication in constructing a new steam generator just as the calculation of the orientation of the cylindrical member creates a complication in the construction of a new steam generator. These complications translate into increased cost and time for manufacture of a steam generator.

It is an object of the present invention to reduce costs and manufacturing time required for the construction of a steam generator.

It is another object of the invention to eliminate the need to calculate the orientation of the hanger structure for each new steam generator.

A further object of the invention is to provide apparatus that will reduce or eliminate bending moments on the legs of the hanger rods.

Still another object of the invention is to eliminate the requirement to stock or manufacture a range of mounting structures.

SUMMARY OF THE INVENTION

It has now been found that these and other objects of the invention may be attained in a steam generator having a steam drum and which includes first and second U-shaped members dimensioned and configured for cradling the steam drum. Each of the first and second U-shaped members has first and second elongated leg portions and each of the leg portions is supported by a separate first body. The first body is supported by a separate second body, one of the bodies has a concave spherical section face and the other has a convex spherical section face, the concave spherical section face and the convex spherical section face are disposed in abutting load bearing relationship. Thus, a discrete set of first and second bodies is associated with each of the leg portions.

In some forms of the invention each of the first bodies and the second bodies has a bore disposed therein dimensioned for passage of one of the leg portions, each of the leg portions extending through a separate set of bodies that includes one first and one second body. Each of the leg portions may have an axial portion thereof that is threaded and the apparatus further includes a nut engaging the threaded portion. The nut is disposed in abutting relationship to the first body. In some forms of the invention each of the first bodies has a concave spherical section face.

The apparatus may further include a bushing disposed intermediate the face of the first body and the face of the second body. The bushing may be a bronze bushing of a self lubricating type. Some forms of the bushing may have a lip extending around the surface thereof which may be dimensioned and configured to engage a groove in the concave spherical section face.

In some forms of the invention the largest cross-sectional area of the bore in the first body has a smaller cross sectional area than the largest cross-sectional area of the bore in the second body.

DESCRIPTION OF THE PREFERRED EMBODIMENT

Figure 1:
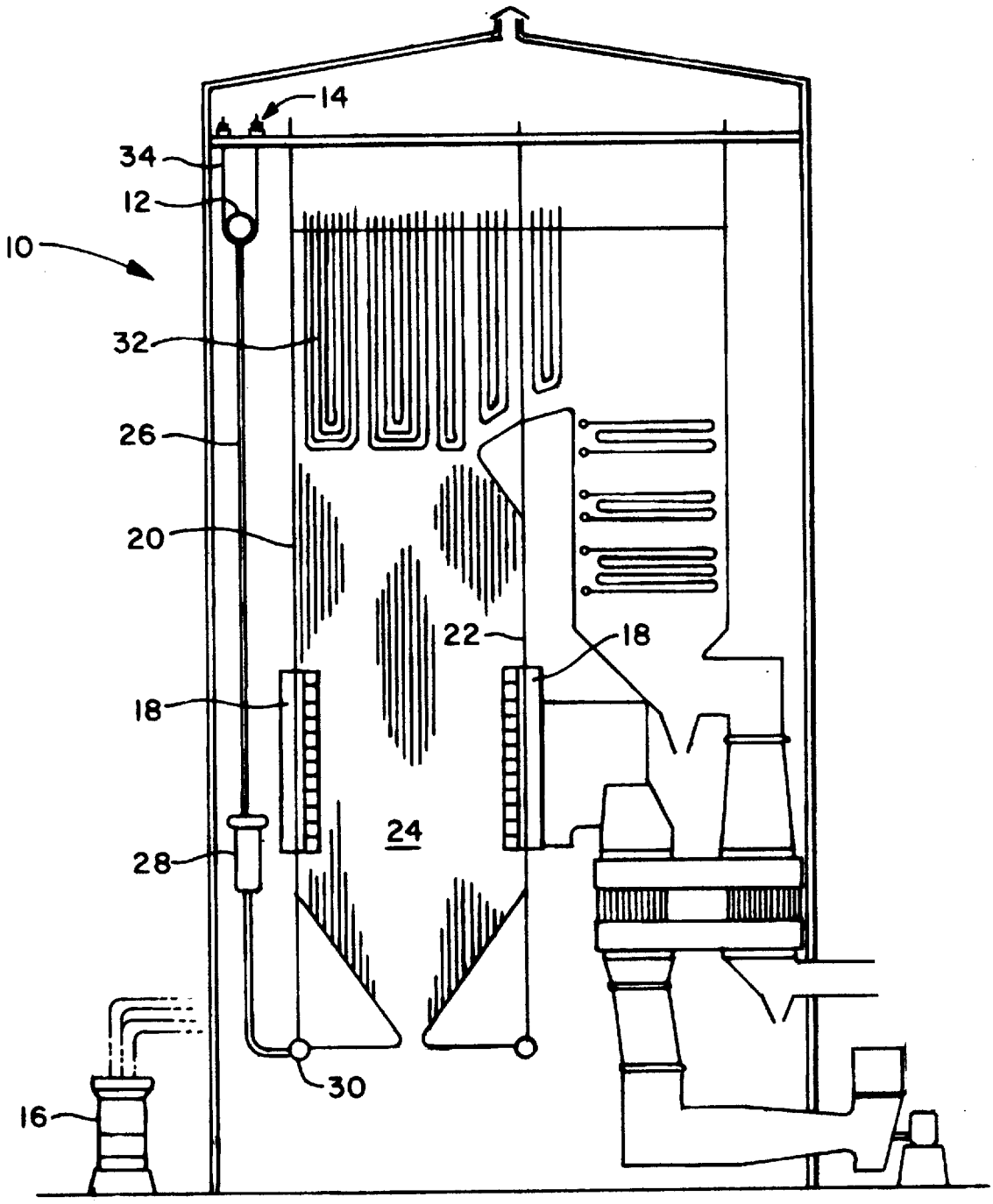
FIG. 1 is a partially schematic elevational view of a steam generator incorporating the present invention.

Referring now to FIG. 1 there is shown a steam generator 10 incorporating a steam drum 12 carried by drum hanger assembly 14. The steam generator is illustrative of various steam generators that may incorporate the drum hanger assembly 14 in accordance with the present invention. The illustrated steam generator 10 is a controlled circulation tangentially fired pulverized coal fired reheat steam generator designed to provide steam to a large high subcritical pressure turbine generator. In a typical installation six pulverizers 16 supply coal to tilting tangential fuel nozzles 18 located in each of the four comers of the furnace. The furnace has a front wall 20, a rear wall 22 and a side wall 24. The other side wall has been omitted to better illustrate the overall apparatus. Each of these walls is a waterwall. The supply of water to the waterwalls begins with the steam drum 12. The water travels through downcomers 26 to the suction manifold into the boiler water circulating pumps 28 from which it is discharged into a lower ring header 30. A mixture of steam and liquid water flow up through the various heated circuits is collected in an arrangement of waterwall outlet headers (not shown) located just above the furnace roof. The steam-water mixture passes through connecting tubes (not shown) to the drum 12, where steam is separated from boiler water and passes to a superheater 32.

Figure 3:
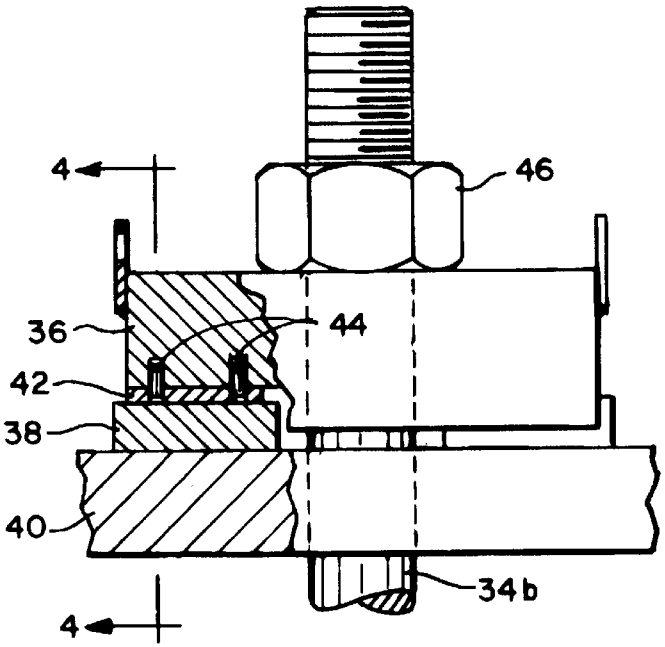
FIG. 3 PRIOR ART
FIG. 3 is a more detailed view of the cylindrical member, partially broken away, that appears in FIG. 2.
Figure 4:
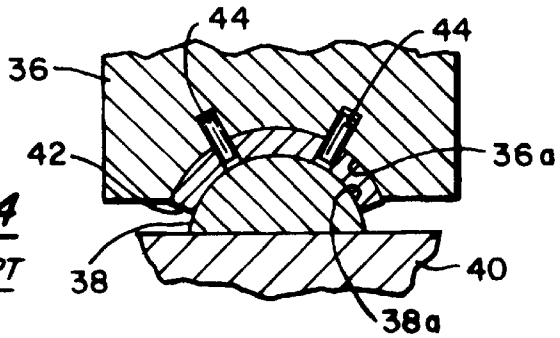
FIG. 4 PRIOR ART
FIG. 4 is a sectional view taken along the line 4—4 of FIG. 3.
Figure 2:
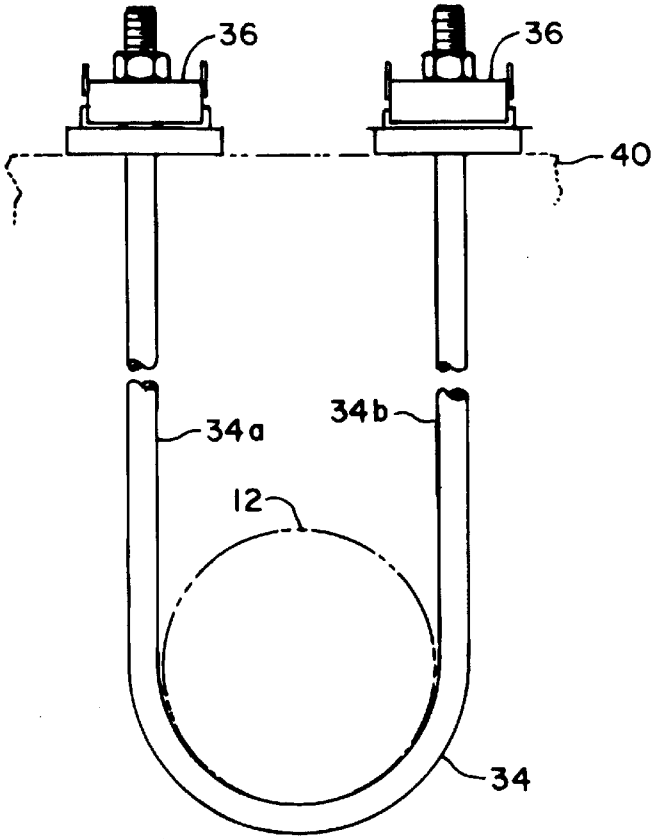
FIG. 2 PRIOR ART
FIG. 2 is an elevational view illustrating the relationship between the prior art hanger rod assembly and the steam drum.

Referring now to FIGS. 2–4, the prior art approach to supporting the steam drum 12 utilized two giant U-shaped members. These U-shaped members, also referred to as U bolts or drum hanger rods 34, cradle the ends of the steam drum 12 with the two legs 34*a*, 34*b* of each rod 34 extending straight up. Each of the upper ends of the legs 34*a*, 34*b* extend through a vertical bore in a discrete member 36. The threaded axial extremity of each leg engages a nut 46. Thus, relative motion between the upper end of the leg 34*a* or 34*b* and the member 36 is prevented. Thus, the upper end of each leg 34*a* or 34*b* is suspended from a members 36 that have a downwardly facing concave cylindrical surface 36*a*. A convex cylindrical surface 38 is disposed below the surface 36*a*. The convex cylindrical surface 38 is supported by a rigid support member 40. A cylindrical section shaped bushing 42, that is coupled to the convex cylindrical surface 38 by pins 44, 44, is disposed in abutting relationship to the surface 36*a* and the surface 38*a*. It will thus be seen that each leg 34*a*, 34*b* can move through a plurality of paths within a single plane. More specifically, each leg can turn about the center of curvature of the surface 36*a*, surface 38*a* and the bushing 42. While this structure has been satisfactory for many installations, the structure of the present invention offers important advantages.

Referring now to FIGS. 5 through 9*b*, there is shown the hanger rod assembly 14 in accordance with a preferred form of the present invention. The hanger rod 34 is the same in both the prior art and the apparatus of the present invention. As noted above the prior art structure relied on the interface of two cylindrical section shaped abutting surfaces. This inherently limited the range of movement of the legs 34*a*, 34*b*. The present invention relies on the interface of two abutting spherical section shaped surfaces. The substitution inherently allows greater freedom of movement of the legs 34*a*, 34*b* and thus achieves the objects of the present invention.

The more specific description of the apparatus in accordance with the present invention will be better understood by expressly considering the definition of the term "spherical section" as used herein. The ball used to play table tennis (ping pong) is an example of a hollow sphere. The term "section" has a definition: a part set off by or as if by cutting. Thus, the term "spherical section" refers herein to any part of a hollow sphere. Any part of the hollow body of a table tennis ball is illustrative of a spherical section it will be understood that the outer face of the sphere is convex and the inner face of the hollow sphere is concave.

Figure 6:
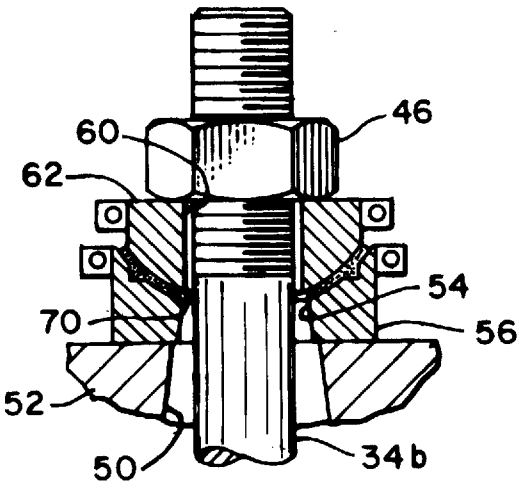
FIG. 6 is a more detailed view, similar to FIG. 3, illustrating the spherical structure in accordance with the preferred form of the present invention.
Figure 5:
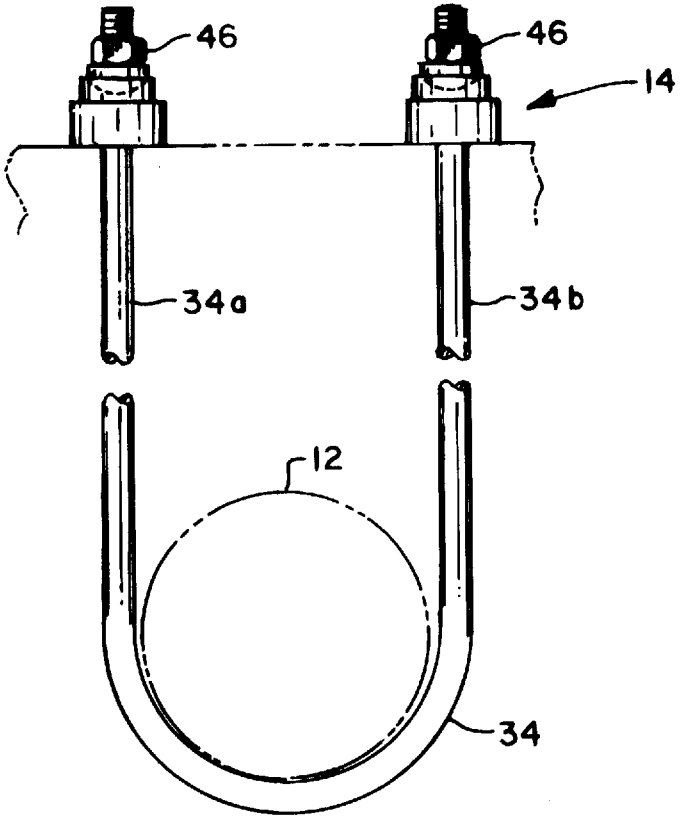
FIG. 5 is an elevation view of the hanger rod assembly in accordance with a preferred form of the present invention.
Figure 9A:
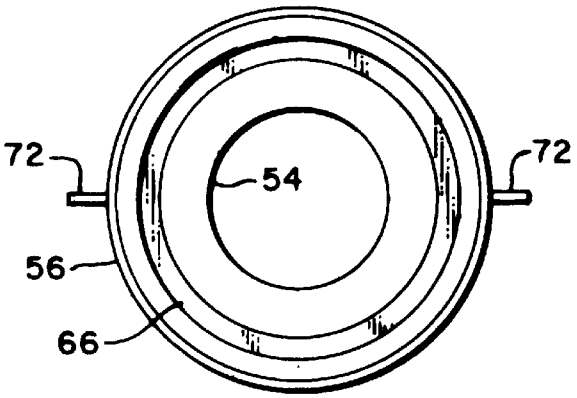
FIG. 9*a* is a plan view of a spherical base which is part of the assembly illustrated in FIG. 6.
Figure 9B:
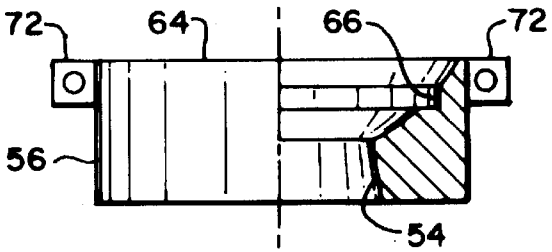
FIG. 9*b* is an elevational view, in partial section of the spherical base illustrated in FIG. 9*a*.
Figure 8A:
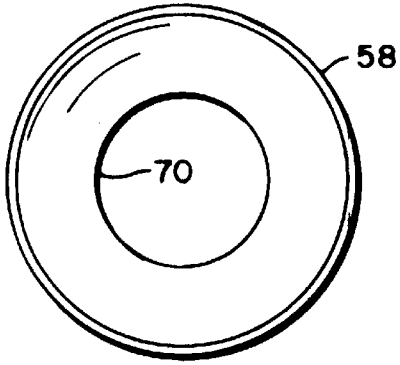
FIG. 8*a* is a plan view of a bushing that is part of the assembly illustrated in FIG. 6.
Figure 8B:
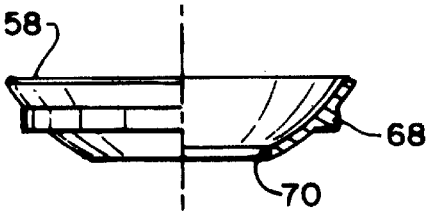
FIG. 8*b* is an elevational view, in partial section of the bushing illustrated in FIG. 8*a*.
Figure 7A:
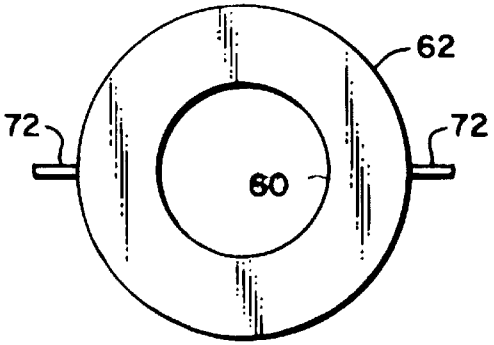
FIG. 7*a* is a plan view of a spherical rocker which is part of the assembly illustrated in FIG. 6FIG.
Figure 7B:
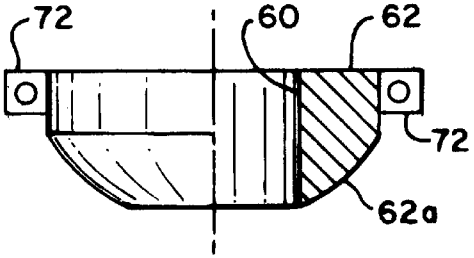
FIG. 7*b* is an elevational view, in partial section of the spherical rocker illustrated in FIG. 7*a*.

As best seen in FIGS. 5 and 6 the upper end 34*b* of the rod 34 extends through a tapered bore 50 in a rigid support member 52. The same upper end 34*b* also extends through a tapered bore 54 in a base 56 as well as a bore in a bushing 58 in addition to a bore 60 in a spherical rocker 62. By referring to FIGS. 5, 6, 7*a* and 7*b* it will be apparent that lower face 62*a* of the spherical rocker 62 is a spherical section and that the face 62*a* is convex As best seen in FIGS. 6, 9*a*, and 9*b* the base 56 has an upper face 64 that is concave and is also a spherical section. A groove 66 is machined into the upper face 64 of the base 56. The groove 66 cooperates with a lip 68 on the bushing 58 that is disposed intermediate the base 56 and the spherical rocker 62. The lip 68 is important for holding the spherical rocker 62 during machining. The central bore 70 in the bushing 58 is best seen in FIGS. 8*a* and 8*b*. That bore 70 allows free movement of the end 34*b* within the bores 60, 54, and 50. Lifting lugs 72 are provided on both the base 56 and the spherical rocker 62. In the preferred embodiment the base 56 and the spherical rocker 62 are manufactured from a carbon steel.

The bushing 58 is preferably a self lubricating bronze bushing. In the preferred embodiment the material is ASTM B22C86300. Other embodiments use other low friction materials. Ordinarily, the low friction material will be softer than the carbon steel members that contact the low friction material. The lip 68 is provided primarily to position the bushing 58 during machining operations. The lip 68 mates with the groove 66 in the base 56. The cooperation therebetween is helpful to prevent relative motion although the lip 68 is primarily useful for holding the bushing 58 during machining operations. Ordinarily, the interface between the bushing 58 and the rocker 62 will be sprayed with an anti-seize lubricant such as a copper based spray satisfying MIL-A-907 before final assembly. One such spray is marketed under the trademark FEL-PRO C5-A. Other commercial alternatives are available.

As best seen in FIG. 6 the tapered holes 50 and 54 allow movement of the leg 34*b* as the result of thermal expansion, accidental pipe rupture, or an earthquake. The increasingly larger diameter of the respective holes allow a substantially cone shaped space within which the leg 34*a* or 34*b* is free to move.

The foregoing description of the preferred embodiment is intended to be illustrative of the present invention. Various otherforms are also contemplated by the infection. For example, the preferred embodiment has been described as what might be considered to be a convex spherical section part riding on a concave spherical section part. It will be understood that other forms of the invention may have the concave spherical section part riding on a fixed convex spherical section part. Similarly, the invention has been described in terms of these parts having a central bore through which the leg 34*a* or 34*b* extends. An alterative construction utilizes an inverted U-shaped or yoke shaped member that rides around the upper of the 2 spherical section parts.

The preferred embodiment incorporates tapered bores 54, 50 to provide the desired combination of strength and clearance for movement of the leg 34*b*. Other embodiments may incorporate cylindrical bores without departing from the spirit of the invention. Although the preferred embodiment has a lip 68 on the bushing 58, other forms of the invention may provide a lip on the base 56 that engages the bushing 58.

The apparatus in accordance with the invention makes possible the standardization of the mounting for steam drums of all sizes. In other words, the mounting is suitable for steam drums weighing from 50 to 350 tons. This is important because it eliminates the requirement to manufacture a range of hanger assemblies. The apparatus of the present invention is also advantageous because they eliminate the need to individually calculate the angular orientation of the hanger assemblies for each new steam generator. It is also advantageous that the invention eliminates or substantially eliminates bending of the hanger rods as well as decreasing the overall cost of building a steam generator.

The invention has been described with reference to its illicit preferred embodiment. Persons skilled in the art of such devices may upon exposure to the teachings herein, conceive other variations. Such variations are deemed to be encompassed by the disclosure, the invention being delimited only by the following claims.

Having thus described my invention, I claim:

1. Apparatus for supporting an associated steam drum in an associated steam generator which comprises:

first and second U-shaped members dimensioned and configured for cradling the associated steam drum of the associated steam generator; each of said first and second U-shaped members having first and second elongated leg portions;

each of said leg portions being supported by a separate first body and said first body being supported by a separate second body, one of said bodies having a concave spherical section face and the other having a convex spherical section face, said concave spherical section face and said convex spherical section face being disposed in abutting load bearing relationship, whereby a discrete set of first and second bodies is associated with each of said leg portions, each of said first bodies and said second bodies has a tapered bore disposed therein dimensioned for passage and free movement of one of said leg portions, each of said leg portions extending through a separate set of bodies that includes one first and one second body.

2. The apparatus as described in claim 1 wherein:

each of said leg portions has an axial portion thereof that is threaded and said apparatus further includes a nut engaging said threaded portion, said nut being disposed in abutting relationship to said first body.

3. The apparatus as described in claim 2 wherein:

each of said first bodies has a concave spherical section face.

4. The apparatus as described in claim 3 wherein:

said apparatus further includes a bushing disposed intermediate said face of said first body and said face of said second body.

5. The apparatus as described in claim 4 wherein:

said bushing is a bronze bushing.

6. The apparatus as described in claim 5 wherein:

said bushing is a self lubricating bushing.

7. The apparatus as described in claim 6 wherein:

said bushing has a lip extending around the surface thereof.

8. The apparatus as described in claim 7 wherein said lip is dimensioned and configured to engage a groove in said concave spherical section face.

9. The apparatus as described in claim 8 wherein:

the largest cross-sectional area of said bore in said first body has a smaller cross sectional area than the largest cross-sectional area of said bore in said second body.

10. A steam generator apparatus which comprises:

a boiler having waterwalls, a steam drum and apparatus for supporting an associated steam drum; said apparatus for supporting including first and second U-shaped members dimensioned and configured for cradling the associated steam drum of the associated steam generator; each of said first and second U-shaped members having first and second elongated leg portions;

first and second U-shaped members dimensioned and configured for cradling the associated steam drum of the associated steam generator; each of said first and second U-shaped members having first and second elongated leg portions;

each of said leg portions being supported by a separate first body and said first body being supported by a separate second body, one of said bodies having a concave spherical section face and the other having a convex spherical section face, said concave spherical section face and said convex spherical section face being disposed in abutting relationship, whereby a discrete set of first and second bodies is associated with each of said leg portions, each of said first bodies and said second bodies has a tapered bore disposed therein dimensioned for passage and free movement of one of said leg portions, each of said leg portions extending through a separate set of bodies that includes one first and one second body.

11. The apparatus as described in claim 10 wherein:

each of said leg portions has an axial portion thereof that is threaded and said apparatus further includes a nut engaging said threaded portion, said nut being disposed in abutting relationship to said first body.

12. The apparatus as described in claim 11 wherein:

each of said first bodies has a concave spherical section face.

13. The apparatus as described in claim 12 wherein:

said apparatus further includes a bushing disposed intermediate said face of said first body and said face of said second body.

14. The apparatus as described in claim 13 wherein:

said bushing is a bronze bushing.

15. The apparatus as described in claim 14 wherein:

said bushing is a self lubricating bushing.

16. The apparatus as described in claim 15 wherein:

said bushing has a lip extending around the surface thereof.

17. The apparatus as described in claim 16 wherein said lip is dimensioned and configured to engage a groove in said face that is a concave spherical section face.

18. The apparatus as described in claim 17 wherein:

the largest cross-sectional area of said bore in said first body has a smaller cross sectional area than the largest cross-sectional area of said bore in said second body.

* * * * *